US011572525B2

(12) United States Patent
Tamura

(10) Patent No.: US 11,572,525 B2
(45) Date of Patent: Feb. 7, 2023

(54) LUBRICATING OIL COMPOSITION

(71) Applicant: Idemitsu Kosan Co., Ltd., Chiyoda-ku (JP)

(72) Inventor: Kazushi Tamura, Chiba (JP)

(73) Assignee: Idemitsu Kosan Co., Ltd., Chiyoda-ku (JP)

( * ) Notice: Subject to any disclaimer, the term of this patent is extended or adjusted under 35 U.S.C. 154(b) by 0 days.

(21) Appl. No.: 17/287,146

(22) PCT Filed: Oct. 25, 2019

(86) PCT No.: PCT/JP2019/041868

§ 371 (c)(1),
(2) Date: Apr. 21, 2021

(87) PCT Pub. No.: WO2020/085478

PCT Pub. Date: Apr. 30, 2020

(65) Prior Publication Data

US 2021/0395636 A1 Dec. 23, 2021

(30) Foreign Application Priority Data

Oct. 26, 2018 (JP) ..... JP2018-201519

(51) Int. Cl.

| | |
|---|---|
| ***C10M 169/04*** | (2006.01) |
| ***C10M 143/00*** | (2006.01) |
| ***C10M 145/14*** | (2006.01) |
| ***C10M 157/10*** | (2006.01) |
| ***C10N 40/04*** | (2006.01) |
| ***C10N 20/02*** | (2006.01) |
| ***C10N 30/02*** | (2006.01) |
| ***C10N 40/08*** | (2006.01) |

(52) U.S. Cl.

CPC ..... *C10M 169/041* (2013.01); *C10M 143/00* (2013.01); *C10M 145/14* (2013.01); *C10M 157/10* (2013.01); *C10M 2205/022* (2013.01); *C10M 2209/084* (2013.01); *C10N 2020/02* (2013.01); *C10N 2030/02* (2013.01); *C10N 2040/042* (2020.05); *C10N 2040/08* (2013.01)

(58) Field of Classification Search

CPC ..... C10M 143/00; C10M 145/14; C10M 157/10; C10M 169/041; C10M 2205/022; C10M 2209/084; C10M 2020/02; C10M 2030/02; C10M 2040/042; C10M 2040/08

See application file for complete search history.

(56) References Cited

U.S. PATENT DOCUMENTS

| | | | | |
|---|---|---|---|---|
| 2008/0015131 | A1* | 1/2008 | Vinci | C10M 157/04 508/470 |
| 2010/0075875 | A1* | 3/2010 | Yaguchi | C10M 169/04 508/192 |
| 2011/0077183 | A1* | 3/2011 | Murata | C10M 169/04 508/473 |
| 2015/0057202 | A1* | 2/2015 | Nakao | C10M 169/041 508/469 |
| 2017/0088789 | A1* | 3/2017 | Grisso | C10M 157/00 |
| 2019/0002784 | A1* | 1/2019 | Boffa | C10M 137/10 |
| 2021/0147760 | A1* | 5/2021 | Vincent | C10M 135/10 |

FOREIGN PATENT DOCUMENTS

| | | | | |
|---|---|---|---|---|
| CN | 104560297 | A | 4/2015 | |
| JP | 6-228530 | A | 8/1994 | |
| JP | 2005-307099 | A | 11/2005 | |
| JP | 2014-55214 | A | 3/2014 | |
| JP | 2015-98592 | A | 5/2015 | |
| WO | 02/083825 | A1 | 10/2002 | |
| WO | WO-2019005738 | A1 * | 1/2019 | C10M 135/10 |
| WO | WO 2019/163996 | A1 | 8/2019 | |

OTHER PUBLICATIONS

International Search Report dated Dec. 10, 2019 in PCT/JP2019/041868 filed Oct. 25, 2019, 1 page.
Supplementary European Search Report dated Jul. 8, 2022, in European Patent Application No. 19875652.0 filed Oct. 25, 2019.
Office Action dated Mar. 9, 2022, in Chinese Patent Application No. 201980069169.3 (with English translation).

* cited by examiner

*Primary Examiner* — James C Goloboy
(74) *Attorney, Agent, or Firm* — Oblon, McClelland, Maier & Neustadt, L.L.P.

(57) ABSTRACT

A lubricating oil composition may include a base oil (A), an olefin copolymer (B), and a poly(alkyl(meth)acrylate) (C), in which a weight average molecular weight of the olefin copolymer (B) is 10,000 to 80,000, a content of the olefin copolymer (B) is 0.01% to 0.23% by mass based on the total amount of the lubricating oil composition, and a content of the poly(alkyl(meth)acrylate) (C) is 0.02% to 0.40% by mass based on the total amount of the lubricating oil composition.

13 Claims, No Drawings

LUBRICATING OIL COMPOSITION

TECHNICAL FIELD

The present invention relates to a lubricating oil composition.

BACKGROUND ART

A lubricating oil composition used for lubricating the sliding parts of various devices such as a hydraulic system, a stationary transmission, and an automotive transmission is required to have properties that an oil film is easily formed while having a certain fluidity in both high-temperature and low-temperature environments.

In general, the viscosity of the lubricating oil composition is likely to change when the temperature changes. For example, when the viscosity is significantly decreased, it tends to be difficult for an oil film to be formed; however, when the viscosity is significantly increased, the fluidity is impaired, which is problematic. For this reason, the lubricating oil composition must have a small temperature dependency on viscosity.

Another function of the lubricating oil composition is the cooling effect. The lubricating oil composition cooled by an oil cooler or the like can cool the sliding part and the surrounding part thereof.

For example, Patent Literature 1 discloses, as a drive-system lubricating oil composition with viscosity characteristics, shear stability, and less heat generation due to friction, a drive-system lubricating oil composition consisting of 85% to 99.9% by mass of a lubricating oil base oil having predetermined kinetic viscosity and viscosity index and 0.1% to 15% by mass of an ethylene-α-olefin copolymer having predetermined properties.

CITATION LIST

Patent Literature

Patent Literature 1: JP 2005-307099 A

SUMMARY OF INVENTION

Technical Problem

Then, a lubricating oil compositions cooled by an oil cooler or the like is also required to have lubricity as well as the cooling effect, but in general, in a low temperature environment, it is difficult to balance both fluidity and oil film-forming ability in some cases. Therefore, there is a demand for a lubricating oil composition having low-temperature viscosity characteristics that include both fluidity and oil film-forming ability, assuming the use in a low-temperature environment.

Solution to Problem

The present invention provides a lubricating oil composition comprising an olefin copolymer having a specific molecular weight and a poly(alkyl(meth)acrylate) in predetermined proportions.

More specifically, the present invention provides the following [1] to [12].

[1] A lubricating oil composition comprising a base oil (A), an olefin copolymer (B), and a poly(alkyl(meth)acrylate) (C), wherein a weight average molecular weight of the olefin copolymer (B) is 10,000 to 80,000, a content of the olefin copolymer (B) is 0.01% to 0.23% by mass based on the total amount of the lubricating oil composition, and a content of the poly(alkyl(meth)acrylate) (C) is 0.02% to 0.40% by mass based on the total amount of the lubricating oil composition.

[2] The lubricating oil composition according to [1], wherein the weight average molecular weight of the poly(alkyl(meth) acrylate) (C) is 5,000 to 100,000.

[3] The lubricating oil composition according to [1] or [2], wherein a ratio of the content of the component (B) to the content of the component (C) [(B)/(C)] is 0.2 to 6.0.

[4] The lubricating oil composition according to any one of [1] to [3], wherein a total content of the component (B) and the component (C) is 0.03% to 0.63% by mass based on the total amount of the lubricating oil composition.

[5] The lubricating oil composition according to any one of [1] to [4], wherein a kinetic viscosity of the lubricating oil composition at 40° C. is 6.0 to 18.0 $mm^2/s$.

[6] The lubricating oil composition according to any one of [1] to [5], wherein a BF viscosity of the lubricating oil composition at −40° C. is 5,000 mPa·s or more.

[7] The lubricating oil composition according to any one of [1] to [6], wherein a pour point of the lubricating oil composition is −35° C. or less.

[8] The lubricating oil composition according to any one of [1] to [7], wherein the lubricating oil composition is used in a hydraulic system, a stationary transmission, an automotive transmission, or a cooling system for at least one of a motor and a battery.

[9] A method of producing the lubricating oil composition according to any one of [1] to [8], the method comprising a step of blending a base oil (A) with an olefin copolymer (B) and a poly(alkyl(meth)acrylate) (C).

[10] A device using the lubricating oil composition according to any one of [1] to [7].

[11] The device according to [10], wherein the device is a hydraulic system, a stationary transmission, an automotive transmission, or a cooling system for at least one of a motor and a battery.

[12] Use of a lubricating oil composition, the use comprising using the lubricating oil composition according to any one of [1] to [7] in a hydraulic system, a stationary transmission, an automotive transmission, or a cooling system for a motor or a battery.

Advantageous Effects of Invention

The lubricating oil composition in one preferred embodiment of the present invention has low-temperature viscosity characteristics that include both fluidity and oil film-forming ability.

DESCRIPTION OF EMBODIMENTS

The kinetic viscosity and the viscosity index described herein mean the values measured or calculated in accordance with JIS K2283:2000.

The weight average molecular weight (Mw) and number average molecular weight (Mn) described herein each mean a standard polystyrene equivalent value measured by a gel permeation chromatography (GPC) method, and specifically, a value measured by the method described in the Examples below.

[Configuration of Lubricating Oil Composition]

The lubricating oil composition of the present invention comprises a base oil (A), an olefin copolymer (B), and a poly(alkyl(meth)acrylate) (C).

The lubricating oil composition of the present invention, in which an olefin copolymer (B) and a poly(alkyl(meth) acrylate) (C) are used in combination as polymer components in predetermined proportions, can retain suitable viscosity even for use in a low temperature environment and thus can have low-temperature viscosity characteristics that include both fluidity and oil film-forming ability.

The poly(alkyl(meth)acrylate) (C) plays a role as a pour point depressant and contributes to the improvement of fluidity of the obtained lubricating oil composition in a low temperature environment. However, with the poly(alkyl (meth)acrylate) (C) alone, the viscosity of the lubricating oil composition in a low temperature environment is low, and there is a concern that the oil film-forming ability may be lowered.

To solve such a problem, it was found that by using the olefin copolymer (B) having a predetermined molecular weight and the poly(alkyl(meth)acrylate) (C) in combination in predetermined proportions, it is possible to obtain a lubricating oil composition having excellent low temperature viscosity characteristics, which has high viscosity and improved oil film-forming ability while ensuring favorable fluidity in a low temperature environment.

For the lubricating oil composition in one aspect of the present invention, the content ratio [(B)/(C)] of the component (B) to the component (C) is preferably 0.2 to 6.0, more preferably 0.25 to 5.0, still more preferably 0.3 to 4.0, and even more preferably 0.4 to 3.0 in terms of mass ratio from the viewpoint of obtaining the lubricating oil composition having excellent low-temperature viscosity characteristics described above.

For the lubricating oil composition in one aspect of the present invention, the total content of the component (B) and the component (C) is preferably 0.03% to 0.63% by mass, more preferably 0.05% to 0.60% by mass, more preferably 0.07% to 0.55% by mass, and even more preferably 0.10% to 0.50% by mass based on the total amount (100% by mass) of the lubricating oil composition from the viewpoint of obtaining the lubricating oil composition having excellent low-temperature viscosity characteristics described above.

The components (B) and (C) are often commercially available in the form of a solution dissolved in a diluted oil, in consideration of handling and solubility with the base oil (A).

The content of the components (B) and (C) described herein is the content converted to the content of resin constituting the components (B) and (C) in a solution diluted with a diluted oil excluding the mass of the diluted oil.

The lubricating oil composition in one aspect of the present invention may further comprise additives for lubricating oil other than the above components (B) and (C), if necessary, as long as the effects of the present invention are not impaired.

In the lubricating oil composition in one aspect of the present invention, the total content of the components (A), (B), and (C) based on the total amount (100% by mass) of the lubricating oil composition is preferably 70% to 100% by mass, more preferably 80% to 100% by mass, still more preferably 85% to 100% by mass, and even more preferably 90% to 100% by mass.

Hereinafter, details of each component comprised in the lubricating oil composition in one aspect of the present invention will be described.

Base Oil (A)

The base oil (A) used in one aspect of the present invention is one or more kinds selected from mineral oils and synthetic oils.

Examples of mineral oils include: atmospheric pressure residual oils obtained by distillation of paraffinic crude oil, intermediate-base crude oil, naphthenic crude oil, and the like; distillates obtained by distilling these atmospheric pressure residual oils under reduced pressure; refined oils obtained by treating these distillates via one or more purification treatments such as solvent deasphalting, solvent extraction, hydrogenolysis, solvent dewaxing, catalytic dewaxing, and hydrorefining; and mineral oils (GTL) obtained by isomerizing wax (gas-to-liquid (GTL) wax) produced from natural gas by the Fischer-Tropsch method or the like.

Examples of synthetic oils include: poly α-olefins such as α-olefin homopolymers or α-olefin copolymers (e.g., α-olefin copolymers having 8 to 14 carbon atoms such as ethylene-α-olefin copolymers); isoparaffin; polyalkylene glycol; ester oils such as polyol ester, dibasic acid ester, and phosphate ester; ether oils such as polyphenyl ether; alkyl benzene; and alkyl naphthalene.

It is preferable that the base oil (A) used in one aspect of the present invention is one or more kinds selected from mineral oils and synthetic oils classified as Group 2 and Group 3 of the American Petroleum Institute (API) Base Oil categories.

The kinetic viscosity of the base oil (A) used in one aspect of the present invention at 40° C. is preferably 6.0 to 18.0 $mm^2/s$, more preferably 6.5 to 15.0 $mm^2/s$, still more preferably 7.0 to 13.0 $mm^2/s$, and even more preferably 7.5 to 11.5 $mm^2/s$.

The viscosity index of the base oil (A) used in one aspect of the present invention is preferably 70 or more, more preferably 75 or more, still more preferably 80 or more, and even more preferably 85 or more.

In one aspect of the present invention, when a mixed oil in which two or more kinds of base oils are combined is used as the base oil (A), the kinetic viscosity and the viscosity index of the mixed oil are preferably in the above ranges.

In the lubricating oil composition in one aspect of the present invention, the content of the base oil (A) based on the total amount (100% by mass) of the lubricating oil composition is preferably 60% to 99.5% by mass, more preferably 70% to 99.0% by mass, still more preferably 80% to 98.0% by mass, and even more preferably 85% to 97.0% by mass.

<Olefin Copolymer (B)>

The lubricating oil composition of the present invention comprises an olefin copolymer (B) having a weight average molecular weight (Mw) of 10,000 to 80,000.

When the Mw of the olefin copolymer is less than 10,000 and when the Mw is more than 80,000, it is difficult to prepare adjust the viscosity of the obtained lubricating oil composition to a high level in a low temperature environment, and there is concern that the oil film-forming ability may decrease in the low temperature environment.

From the above viewpoint, the weight average molecular weight of the olefin copolymer (B) used in one aspect of the present invention is preferably 11,000 to 65,000, more preferably 12,000 to 50,000, still more preferably 13,000 to 40,000, even more preferably 14,000 to 30,000, and particularly preferably 15,000 to 20,000.

The content of the olefin copolymer (B) in the lubricating oil composition in one aspect of the present invention is 0.01% to 0.23% by mass based on the total amount (100% by mass) of the lubricating oil composition.

When the content of the component (B) is less than 0.01% by mass, the viscosity of the obtained lubricating oil composition in a low temperature environment is low, and there is a concern that the oil film-forming ability may decrease. Meanwhile, when the content of the component (B) is more than 0.23% by mass, the pour point of the obtained lubricating oil composition becomes high, and there is a concern that the obtained lubricating oil composition solidifies in a low temperature environment and loses its fluidity.

From the above viewpoints, the content of olefin copolymer (B) in the lubricating oil composition in one aspect of the present invention is preferably 0.02% to 0.22% by mass, more preferably 0.03% to 0.21% by mass, and still more preferably 0.05% to 0.20% by mass based on the total amount (100% by mass) of the lubricating oil composition.

The olefin copolymer (B) used in one aspect of the present invention is a copolymer having a structural unit derived from a monomer having an alkenyl group, and is, for example, an α-olefin copolymer having 2 to 20 carbon atoms (preferably 2 to 16 carbon atoms, more preferably 2 to 14 carbon atoms), and more specifically, an ethylene-α-olefin copolymer is preferable.

The number of carbon atoms of α-olefin that constitutes an ethylene-α-olefin copolymer is preferably 3 to 20, more preferably 3 to 16, still more preferably 3 to 14, and even more preferably 3 to 6.

The olefin copolymer (B) used in the present invention may be a dispersant olefin copolymer.

A dispersant olefin copolymer is, for example, a copolymer obtained by graft-polymerizing the above-described ethylene-a-olefin copolymer with maleic acid, Nvinylpyrrolidone, N-vinylimidazole, glydidyl acrylate, or the like.

The olefin copolymer (B) used in the present invention may be a copolymer further having a structural unit derived from an aromatic monomer as well as a structural unit derived from a monomer having an alkenyl group.

Examples of such an olefin copolymer include styrene-based copolymers such as styrene-diene copolymer and styrene-isoprene copolymer.

<Poly(alkyl(meth)acrylate) (C)>

The lubricating oil composition of the present invention comprises 0.02% to 0.40% by mass of the poly(alkyl(meth) acrylate) (C) based on the total amount of the lubricating oil composition.

When the content of the component (C) is less than 0.02% by mass, the pour point of the obtained lubricating oil composition becomes high, and there is a concern that the obtained lubricating oil composition solidifies in a low temperature environment and loses its fluidity. Meanwhile, when the content of the component (C) is more than 0.40% by mass, the viscosity of the obtained lubricating oil composition in a low temperature environment is low, and there is a concern that the oil film-forming ability may decrease.

From the above viewpoints, in the lubricating oil composition in one aspect of the present invention, the content of the poly(alkyl(meth)acrylate) (C) based on the total amount (100% by mass) of the lubricating oil composition is preferably 0.025% to 0.35% by mass, more preferably 0.03% to 0.30% by mass, still more preferably 0.04% to 0.25% by mass, and even more preferably 0.06% to 0.20% by mass.

The weight average molecular weight of the poly(alkyl (meth)acrylate) (C) used in one aspect of the present invention is preferably 5,000 to 100,000, more preferably 10,000 to 80,000, still more preferably 15,000 to 60,000, and even more preferably 20,000 to 45,000 from the viewpoint of obtaining the lubricating oil composition having excellent low-temperature viscosity characteristics described above.

The poly(alkyl(meth)acrylate) (C) used in one aspect of the present invention may be a polymer having a structural unit derived from alkyl acrylate or alkyl methacrylate (hereinafter collectively referred to as "alkyl(meth)acrylate") or a copolymer having a structural unit derived from a monomer other than alkyl(meth)acrylate.

The number of atoms of an alkyl group of the alkyl(meth) acrylate is preferably 1 to 60, more preferably 1 to 40, and still more preferably 1 to 30.

The content of a structural unit derived from alkyl(meth) acrylate in the poly(alkyl(meth)acrylate) (C) used in one aspect of the present invention preferably 70 to 100 mol %, more preferably 80 to 100 mol %, still more preferably 90 to 100 mol %, and even more preferably 95 to 100 mol % based on the total amount (100 mol %) of structural units of the component (C).

<Additives for Lubricating Oil>

The lubricating oil composition in one aspect of the present invention may comprise additives for lubricating oil other than the above components (B) and (C), if necessary, as long as the effects of the present invention are not impaired.

Examples of such additives for lubricating oil include antioxidants, metallic detergents, dispersants, Friction modifiers, anti-wear agents, extreme pressure agents, anti-foam agents, rust inhibitors, metal inactivating agents, and anti-static agents.

These additives for lubricating oil may be used singly or in combination of two or more kinds thereof.

The content of each of these additives for lubricating oil can be adjusted as appropriate without impairing the effects of the present invention. The content of each additive is usually 0.001% to 15% by mass, preferably 0.005% to 10% by mass, and more preferably 0.01% to 5% by mass independently based on the total amount (100% by mass) of the lubricating oil composition.

<Method of Producing Lubricating Oil Composition>

The method of producing a lubricating oil composition in one aspect of the present invention is not particularly limited. From the viewpoint of productivity, the method includes preferably a step of blending a base oil (A) with an olefin copolymer (B) and a poly(alkyl(meth)acrylate) (C).

From the viewpoint of compatibility with the base oil (A), it is preferable that the olefin copolymer (B) and the poly (alkyl(meth)acrylate) (C) are in the form of a solution dissolved in a diluted oil, and the oil (A) is blended with the solution.

[Description of Lubricating Oil Composition]

The kinematic viscosity of the lubricating oil composition in one aspect of the present invention at 40° C. is preferably 6 to 18.0 $mm^2$ s, more preferably 6.5 to 15.0 $mm^2/s$, still more preferably 7.0 to 13.0 $mm^2/s$, and even more preferably 7.5 to 11.5 $mm^2/s$.

The Brookfield (BF) viscosity of the lubricating oil composition in one aspect of the present invention at −40° C. is preferably 5,000 mPa·s or more, more preferably 7,000 mPa·s or more, still more preferably 8,000 mPa·s or more, and even more preferably 9,000 mPa·s or more, while it is usually 50,000 mPa·s or less from the viewpoint of obtaining a lubricating oil composition having favorable oil film-forming ability.

The BF viscosity described herein means a value measured in accordance with ASTM D2983.

The pour point of the lubricating oil composition in one aspect of the present invention is preferably −35° C. or less, more preferably −37.5° C. or less, and still more preferably −40° C. or less from the viewpoint of obtaining a lubricating oil composition having favorable fluidity in a low temperature environment.

The pour point described herein means a value measured in accordance with JIS K2269:1987.

[Applications of Lubricating Oil Composition]

The lubricating oil composition in one preferred embodiment of the present invention has low-temperature viscosity characteristics that include both fluidity and oil film-forming ability.

Therefore, the lubricating oil composition in one aspect of the present invention can be suitably used in a hydraulic system, a stationary transmission, an automotive transmission, or a cooling system for at least one of a motor and a battery, and in particular, it can be more suitably used in a cooling system for at least one of a motor and a battery.

In addition, given the above-described properties of the lubricating oil composition of the present invention, the invention may also provide the following [1] and [2].

[1] A device using the above-described lubricating oil composition in one aspect of the present invention. It is preferable that the device is a hydraulic system, a stationary transmission, an automotive transmission, or a cooling system for at least one of a motor and a battery.

[2] Use of a lubricating oil composition, which comprises using the above-described lubricating oil composition in one aspect of the present invention in a hydraulic system, a stationary transmission, an automotive transmission, or a cooling system for a motor or a battery.

EXAMPLES

Next, the present invention will be described in more detail with reference to the Examples below, but the present invention is not limited to these examples. The methods of measuring and evaluating various physical properties are as follows:

(1) Kinetic Viscosity, Viscosity Index

Measured and calculated in accordance with JIS K2283:2000.

(2) Weight Average Molecular Weight (Mw), Number Average Molecular Weight (Mn)

Mw and Mn were measured under the following conditions using a gel permeation chromatograph (manufactured by Agilent Technologies, "1260 Type HPLC"), and standard polystyrene equivalent values were used.

(Measurement Conditions)

Column: Two "Shodex LF404" columns connected in sequence.

Column temperature: 35° C.

Eluent: Chloroform

Flow rate: 0.3 mL/min.

(3) BF Viscosity

Measured in accordance with ASTM D2983.

(4) Pour Point

Measured in accordance with JIS K2269:1987.

Examples 1 to 7, Comparative Examples 1 to 12

The base oil, the polymer, and the package of additives were blended according to the types and blending amounts shown in Tables 1 and 2, thereby preparing the respective lubricating oil compositions. The blending amounts of the polymer and the package of additives shown in Tables 1 and 2 are the blending amounts in terms of active ingredients (in terms of resin) excluding the diluted oil.

Details of the base oil, the polymer, and the package of additives used for preparing the lubricating oil compositions are as follows.

<Base Oil>

Base oil (a-1): Paraffin-based mineral oil classified as Group II, kinetic viscosity at 40° C.=9.4 $mm^2/s$, kinetic viscosity at 100° C.=2.6 $mm^2/s$, viscosity index=109.

Base oil (a-2): Paraffin-based mineral oil classified as Group II, kinetic viscosity at 40° C.=8.8 $mm^2/s$, kinetic viscosity at 100° C.=2.4 $mm^2/s$, viscosity index=86.

<Polymers>

OCP (b-1): Ethylene-α-olefin copolymer with Mw=20,000

OCP (b-2): Ethylene-α-olefin copolymer with Mw=15,000

OCP (b'-3): Ethylene-α-olefin copolymer with Mw=8,000

OCP (b'-4): Ethylene-α-olefin copolymer with Mw=100,000

PMA (c-1): Polyalkyl methacrylate with Mw=30,000

<Package of Additives>

Package of additives: Mixture consisting of an antioxidant, an anti-foam agent, a corrosion inhibitor, and an ash-free dispersant (phosphorus atom content=2% by mass, sulfur atom content=1.5% by mass, nitrogen atom content=1.5% by mass based on the total amount (100% by mass) of the mixture).

The prepared lubricating oil compositions were each measured for the kinetic viscosity at 40° C., the BF viscosity at −40° C., and the pour point according to the methods described above. These results are shown in Tables 1 and 2.

TABLE 1

| | | | Ex. 1 | Ex. 2 | Ex. 3 | Ex. 4 | Ex. 5 | Ex. 6 | Ex. 7 |
|---|---|---|---|---|---|---|---|---|---|
| Base oil | Base oil (a-1) | % by mass | 95.87 | 95.80 | 95.70 | 95.70 | 95.60 | — | 95.70 |
| | Base oil (a-2) | % by mass | — | — | — | — | — | 95.75 | — |
| Polymer | OCP (b-1) | % by mass | 0.03 | 0.10 | 0.20 | 0.10 | 0.20 | 0.20 | — |
| | OCP (b-2) | % by mass | — | — | — | — | — | — | 0.10 |
| | OCP (b'-3) | % by mass | — | — | — | — | — | — | — |
| | OCP (b'-4) | % by mass | — | — | — | — | — | — | — |
| | PMA(c-1) | % by mass | 0.10 | 0.10 | 0.10 | 0.20 | 0.20 | 0.05 | 0.20 |
| Additives | Package of additives | % by mass | 4.00 | 4.00 | 4.00 | 4.00 | 4.00 | 4.00 | 4.00 |
| Total | | % by mass | 100.00 | 100.00 | 100.00 | 100.00 | 100.00 | 100.00 | 100.00 |
| OCP/PMA (mass ratio) | | — | 0.30 | 1.00 | 2.00 | 0.50 | 1.00 | 4.00 | 0.50 |
| Description | Kinetic viscosity at 40° C. | $mm^2/s$ | 9.7 | 9.9 | 10.0 | 9.9 | 10.1 | 9.4 | 9.9 |
| | BF viscosity at −40° C. | mPa·s | 6000 | 12000 | 20000 | 10000 | 16000 | 8000 | 16000 |
| | Pour point | ° C. | −42.5 | −42.5 | −40.0 | −42.5 | −40.0 | −37.5 | −40.0 |

TABLE 2

| | | | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|
| Base oil | Base oil (a-1) | % by mass | 95.90 | 95.97 | 95.99 | 95.80 | 95.65 | 95.50 |
| | Base oil (a-2) | % by mass | — | — | — | — | — | — |
| Polymer | OCP (b-1) | % by mass | — | — | — | — | 0.25 | 0.40 |
| | OCP (b-2) | % by mass | — | — | — | — | — | — |
| | OCP (b'-3) | % by mass | — | — | — | — | — | — |
| | OCP (b'-4) | % by mass | — | — | — | — | — | — |
| | PMA (c-1) | % by mass | 0.10 | 0.03 | 0.01 | 0.20 | 0.10 | 0.10 |
| Additives | Package of additives | % by mass | 4.00 | 4.00 | 4.00 | 4.00 | 4.00 | 4.00 |
| Total | | % by mass | 100.00 | 100.00 | 100.00 | 100.00 | 100.00 | 100.00 |
| OCP/PMA (mass ratio) | | — | 0.00 | 0.00 | 0.00 | 0.00 | 2.50 | 4.00 |
| Description | Kinetic viscosity at 40° C. | $mm^2/s$ | 9.7 | 9.6 | 9.6 | 9.8 | 10.1 | 10.4 |
| | BF viscosity at −40° C. | mPa·s | 2100 | 3200 | 35000 | 2400 | 26000 | 60000 |
| | Pour point | ° C. | −45.0 | −35.0 | −32.5 | −45.0 | −32.5 | −22.5 |

| | | | Comp. Ex. 7 | Comp. Ex. 8 | Comp. Ex. 9 | Comp. Ex. 10 | Comp. Ex. 11 | Comp. Ex. 12 |
|---|---|---|---|---|---|---|---|---|
| Base oil | Base oil (a-1) | % by mass | — | — | 95.80 | 95.80 | 95.40 | 95.89 |
| | Base oil (a-2) | % by mass | 95.95 | 95.45 | — | — | — | — |
| Polymer | OCP (b-1) | % by mass | — | 0.50 | — | — | 0.10 | 0.10 |
| | OCP (b-2) | % by mass | — | — | — | — | — | — |
| | OCP (b'-3) | % by mass | — | — | 0.10 | — | — | — |
| | OCP (b'-4) | % by mass | — | — | — | 0.10 | — | — |
| | PMA (c-1) | % by mass | 0.05 | 0.05 | 0.10 | 0.10 | 0.50 | 0.01 |
| Additives | Package of additives | % by mass | 4.00 | 4.00 | 4.00 | 4.00 | 4.00 | 4.00 |
| Total | | % by mass | 100.00 | 100.00 | 100.00 | 100.00 | 100.00 | 100.00 |
| OCP/PMA (mass ratio) | | — | 0.00 | 10.00 | 1.00 | 1.00 | 0.20 | 10.00 |
| Description | Kinetic viscosity at 40° C. | $mm^2/s$ | 9.6 | 10.6 | 9.8 | 10.6 | 10.2 | 9.8 |
| | BF viscosity at −40° C. | mPa·s | 1600 | 30000 | 2200 | 3700 | 4000 | 52000 |
| | Pour point | ° C. | −45.0 | −30.0 | −42.5 | −42.5 | −45.0 | −30.0 |

The results shown in Table 1 confirm that the lubricating oil compositions prepared in Examples 1 to 7 have a high BF viscosity at −40° C. and a low pour point, and thus they have favorable oil film-forming ability and fluidity in a low temperature environment, and have excellent low temperature viscosity characteristics.

Meanwhile, the results shown in Table 2 confirm that the lubricating oil compositions prepared in Comparative Examples 1 to 12 are inferior in at least one of oil film-forming ability and fluidity in a low temperature environment because of a low BF viscosity at −40° C. or a high pour point, indicating that they are inferior in low temperature viscosity characteristics as compared to the lubricating oil compositions of the Examples.

The invention claimed is:

1. A lubricating oil composition, comprising, based on total lubricating oil composition mass:

a base oil (A) in a range of from 85 to 97.0% by mass;

an olefin copolymer (B) in a range of from 0.01% to 0.23% by mass; and a poly(alkyl(meth)acrylate) (C) in a range of from 0.02% to 0.40% by mass, wherein a weight average molecular weight of the olefin copolymer (B) is in a range of from 10,000 to 80,000, wherein a total content of the olefin copolymer (B) and the poly(alkyl(meth)acrylate) (C) is in a range of from 0.10 to 0.50% by mass, based on the total lubricating oil composition mass, and wherein the lubricating oil composition has a pour point of −37.5° C. or less, wherein the lubricating oil composition has a Brookfield (BF) viscosity at −40° C. is 6,000 mPas or more, and wherein the base oil (A) has a viscosity index in a range of from 75 to 109.

2. The composition of claim 1, wherein a weight average molecular weight of the poly(alkyl(meth)acrylate) (C) is in a range of from 5,000 to 100,000.

3. The composition of claim 1, wherein a (B)/(C) ratio of the content of the olefin copolymer (B) to the content of the poly(alkyl(meth)acrylate) (C) is in a range of from 0.2 to 6.0.

4. The composition of claim 1, having a kinematic viscosity at 40° C. is in a range of from 6.0 to 18.0 $mm^2/s$.

5. A method of producing the composition of claim 1, the method comprising:

blending the base oil (A) with the olefin copolymer (B) and the poly(alkyl (meth)acrylate) (C).

6. A device, comprising:

the composition of claim 1.

7. The device of claim 6, which is a hydraulic system, a stationary transmission, an automotive transmission, or a cooling system.

8. A method of lubricating a hydraulic system, a stationary transmission, an automotive transmission, or a cooling system, the method comprising:

contacting the hydraulic system, the stationary transmission, the automotive transmission, or the cooling system with the composition of claim 1.

9. The composition of claim 1, wherein the pour point of the composition is −40° C. or less.

10. The composition of claim 1, wherein the poly(alkyl (meth)acrylate) (C) is the only poly(alkyl(meth)acrylate) in the lubricating oil composition.

11. The composition of claim 1, wherein the olefin copolymer (B) is present in a range of from 0.02 to 0.22% by mass, total based on the lubricating oil composition.

12. The composition of claim 1, wherein the weight average molecular weight of the olefin copolymer (B) is in a range of from 10,000 to 30,000.

13. The composition of claim 1, wherein the base oil (A), the olefin copolymer (B), and the poly(alkyl(meth)acrylate) (C), are present in a range of from 90 to 97.50% by mass, based on the total lubricating oil composition mass.

* * * * *